United States Patent [19]

Freermann

[11] Patent Number: 4,834,232

[45] Date of Patent: May 30, 1989

[54] CONVEYOR GRIPPER FOR A FLAT OBJECT, ESPECIALLY A TEXTILE WEB

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 174,073

[22] Filed: Mar. 28, 1988

[30] Foreign Application Priority Data

Mar. 27, 1987 [DE] Fed. Rep. of Germany ... 8704590[U]

[51] Int. Cl.[4] ..... B65H 20/16; B25B 7/00

[52] U.S. Cl. ..... 198/468.2; 198/803.7; 294/113; 294/119.3; 414/753

[58] Field of Search ..... 198/803.7, 468.2; 414/753; 294/119.3, 106, 113

[56] References Cited

U.S. PATENT DOCUMENTS

| | | | |
|---|---|---|---|
| 3,056,625 | 10/1962 | Timmerman | 294/119.3 |
| 3,203,535 | 8/1965 | Elsas | 198/803.7 |
| 3,204,756 | 9/1965 | Lesch | 198/803.7 |
| 3,250,251 | 5/1966 | Geary | 294/119.3 |
| 3,386,763 | 6/1968 | Ohaway et al. | 294/119.3 |
| 4,108,486 | 8/1978 | Hirmann | 294/119.3 |
| 4,307,801 | 12/1981 | Hänsch | 198/803.7 |

FOREIGN PATENT DOCUMENTS

| | | | |
|---|---|---|---|
| 0102521 | 9/1963 | Norway | 294/119.3 |
| 1398984 | 6/1975 | United Kingdom . | |

*Primary Examiner*—Andres Kashnikow
*Assistant Examiner*—Karen B. Merritt
*Attorney, Agent, or Firm*—Herbert Dubno

[57] ABSTRACT

A conveyor gripper for a substantially flat object, especially a textile web, has two gripping plates forming gripper tongs held in a gripping body. A pressing force which is constant over the entire length of the gripping plates is generated by at least one pressurizable air tube. A plurality of compressable springs distributed over the length of the gripping plates and can act against the pressing force of the air tubes. Also a plurality of safety straps can be located on the gripper body to prevent the spreading out of the gripper body.

10 Claims, 2 Drawing Sheets

CONVEYOR GRIPPER FOR A FLAT OBJECT, ESPECIALLY A TEXTILE WEB

FIELD OF THE INVENTION

My present invention relates to a conveyor gripper for a substantially flat object, especially a textile web.

BACKGROUND OF THE INVENTION

A conveyor gripper for a substantially flat object, especially a textile web or piece of cloth, is known which has two gripping plates attached to one another in a hinge-like manner held in a gripper body.

This conveyor gripper acts to grasp, hold and/or convey or transport a substantially flat object, especially a piece of cloth or textile web. It can also be used for paper, plastic and other workpiece materials. The pressing of both gripping plates against each other is effected by compressable springs which are distributed over the entire length of the gripping plates.

To keep the mass or inertia from being excessive, the entire arrangement should be as light as possible and the gripping plates themselves should be very thin. The compressable springs distributed over a length of several meters do not result in a uniform pressing force over that length. Thus the material slips in the segment between the compressable springs which is particularly undesirable in the processing of textiles.

OBJECTS OF THE INVENTION

It is an object of my invention to provide an improved conveyor gripper for a substantially flat object, especially a piece of cloth or a textile web, which is free from the above disadvantages and difficulties.

It is also an object of my invention to provide an improved conveyor gripper for a substantially flat object, especially a piece of cloth or a textile web, which provides a constant pressing or gripping force over the entire length of the object held in the conveyor gripper.

It is another object of my invention to provide an improved conveyor gripper for a substantially flat object, especially a piece of cloth or a textile web, which provides a constant pressing force over the entire length of the two gripper plates used to hold the object.

SUMMARY OF THE INVENTION

These objects and others which will become more readily apparent hereinafter are attained in accordance with my invention in a conveyor gripper for a substantially flat object, especially a textile web or piece of cloth, comprising two gripping plates attached to each other in a hinge-like way and held in a gripper body.

According to my invention the gripping plates, which form a pair of gripping tongs, are pressable toward each other by at least one air pressurizable inflatable and distendable air tube.

Advantageously two air pressurizable air tubes are provided, each pressing against one of the gripping plates which are hingedly attached with each other so as to push the gripping plates together and grasp the object being gripped.

Alternatively one of the gripping plates can be held rigid or stationary while a single pressurizable air tube acts on a pivotable gripping plate.

To achieve the goals of my invention most advantageously the pressurizable air tube extends over the entire length of the gripper plates.

It can provide on each of its ends with a connecting fitting for the pressurized air. This air tube can be made of an inner rubber tube with an outer protective or reinforcing layer.

In the conveyor gripper a plurality of compressable springs distributed over the length of the gripping plates which act against the pressing force of the air tubes can be provided. Also a plurality of safety straps can be located on the gripper body to prevent excessive spreading of the gripper body.

By the "front" of the conveyor gripper or the gripper body I mean the side of the conveyor gripper or gripper body which grasps or engages the object gripper.

Also advantageously each air tube can be provided with a nonreturn valve in the pressurized air pipe following the connecting fitting for rapid depressurization.

The structure for the conveyor gripper of the substantially flat object, i.e. the textile web, according to my invention has the advantage that the closure or gripping force of the clamping plates over their entire length and thus over the entire length of the gripping device has the same value so that this gripping force can be suddenly applied and also can be quickly raised. Furthermore the use of an air tube satisfies the requirement for a light structure for the conveyor gripper.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
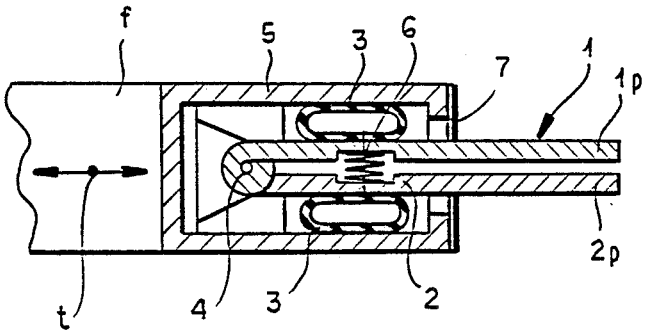
FIG. 1 is a cross sectional view through the operating mechanism of a conveyor gripper according to my invention.

As is apparent from FIG. 1 the conveyor gripper is mounted or positioned on a frame f which travels forward and back as shown by the double arrow t. It comprises a gripper body 5 with a front portion, advantageously of aluminum, open to the front, in which both gripping plates 1, 2 from tongs are held in a hinge-joint or frame joint 4.

A plurality of compression springs 6 distributed over the length of the gripping plates 1, 2 are located between the gripping plates 1, 2. These compression springs 6 have the strength to hold open the gripping plates 1, 2.

Air tubes 3 which extend over the entire length of the apparatus and advantageously are provided with a connecting fitting 8 at both their ends for pressurized air are provided in suitable cavities above and below the gripping plates 1, 2. In another embodiment instead of two air hoses only a single air hose is used when for example a lower gripping plate 2 is rigid or stationary and a pivotable upper gripping plate 1 is pressed against it.

Both gripping plates 1, 2 are provided on their free ends with fingerlike projections 1*p*, 2*p*.

Since considerable forces are taken by the gripper body 5 as a result of inflation of the air tubes 3 with pressurized air and thus the danger exists that the forwardly open front portion of the gripper body 5 is spread out, a plurality of safety straps 7 are located on the gripper body 5 and are attached by screws between the individual fingers of the gripper plates 1, 2 on the front side of the gripper body 5.

Figure 3:
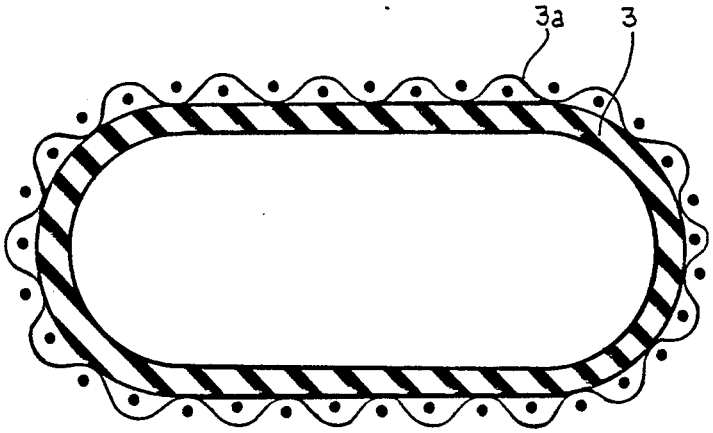
FIG. 3 is a section through the inflatable tube drawn to a larger scale.
Figure 2:
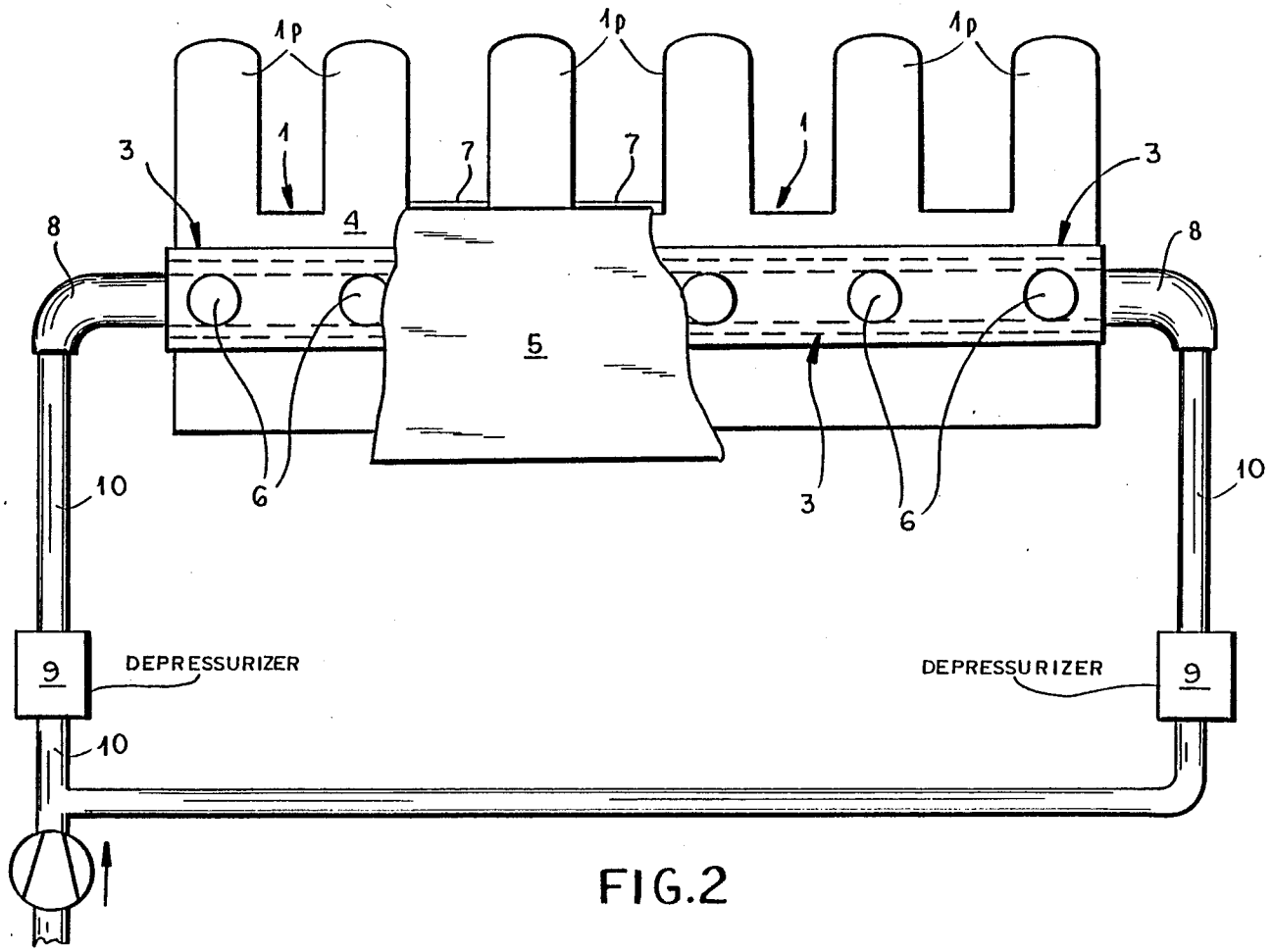
FIG. 2 is a top plan view of the conveyor gripper shown in FIG. 1.

To provide a rapid depressurization of the air tubes it is appropriate to provide a rapid depressurizer 9 comprising for example a nonreturn valve following the connecting fitting 8 by which the pressurized air can be gently removed in sudden pulses or bursts from the air tubes 5 on shutting off the pressure. The air tube 3 appropriately comprises an inner rubber tube with an outer protective layer *3a* (FIG. 3) made for example from fabric or cloth.

I claim:

1. A conveyor gripper for a substantially flat object, especially for a textile web, comprising:

an elongated gripping housing having a front and a back portion, said front portion being formed with an opening;

two substantially identical gripping plates in said housing;

means forming a hinge connecting said plates to each other one end of said plates, said plates protruding beyond said housing through said opening and having opposite free spaced apart ends, said gripping plates having respective outer and inner sides, said inner sides facing each other, each of said inner sides being formed with a recess aligned with the recesses of the other inner side and having identical widths;

spring means in said recesses and including a plurality of springs for displacing said deformable gripping plates away from each other positioned between and spaced apart over the lengths of said gripping plates;

a respective flexible pressurizable oval air tube extending over an entire length of each said plates, each of said flexible oval air tubes having two generally straight opposite portions, one of said portions pressing against said housing and the other pressing against said outer side of the respective gripping plate over a width of said plate at least equal to said width of the respective recess, said tubes being oval during pressurization thereof; and means for pressurizing said flexible tubes, said tubes pressing against the respective gripping plates over the entire length thereof with a uniform pressure inducing a swinging movement of each of said gripping plate toward the other gripping plate with a uniform gripping force between said plates over said length.

2. The conveyor defined in claim 1 wherein said tubes have a pair of connecting fitting for pressurized air provided on opposite ends of said tube.

3. The conveyor defined in claim 2 wherein each of said air tubes is provided with a nonreturn valve for rapid depressurization.

4. The conveyor gripper defined in claim 1 wherein each of said air tubes comprises an inner rubber tube with an outer protective layer.

5. The conveyor defined in claim 1 wherein a plurality of safety straps are provided on said housing to prevent the spreading thereof.

6. A gripper for a textile web, comprising;

a pair of gripping plates;

hinge means connecting said plates together along respective edges of said plates;

a housing enclosing said edges and having walls confronting said plates proximal to said edges, said hinge means connecting said edges to said housing;

respective air tubes received between each of said walls and the respective plate and pressurizeable with compressed air to press said plates toward one another; and a plurality of spaced apart compressible springs distributed over the length of said gripping plates and interposed between them to act against the pressing force of said air tubes.

7. The gripper defined in claim 6 wherein said air tubes each extend over the entire length of said gripper housing and are provided on both ends with connecting fitting for said pressurized air.

8. The gripper defined in claim 6 wherein each of said air tube comprises an inner rubber tube with an outer protective layer.

9. The gripper defined in claim 6 wherein a plurality of safety straps are provided on said gripper housing to prevent the spreading out of said gripper housing.

10. The gripper defined in claim 6 wherein said air tubes are provided with a nonreturn valve for rapid depressurization.

* * * * *